US008888936B2

(12) United States Patent
Strenger et al.

(10) Patent No.: US 8,888,936 B2
(45) Date of Patent: Nov. 18, 2014

(54) PERCHLORATE-FREE PYROTECHNIC MIXTURE

(75) Inventors: Julia Strenger, Hamburg (DE); Dirk Cegiel, Stubben (DE); Christopher Zimmermann, Hamburg (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 0 days.

(21) Appl. No.: 13/306,318

(22) Filed: Nov. 29, 2011

(65) Prior Publication Data

US 2012/0132328 A1 May 31, 2012

Related U.S. Application Data

(60) Provisional application No. 61/470,065, filed on Mar. 31, 2011.

(30) Foreign Application Priority Data

Nov. 29, 2010 (DE) ..... 10 2010 052 628

(51) Int. Cl.

| | |
|---|---|
| ***C06B 43/00*** | (2006.01) |
| ***C06B 47/10*** | (2006.01) |
| ***C06B 31/02*** | (2006.01) |
| ***D03D 23/00*** | (2006.01) |
| ***D03D 43/00*** | (2006.01) |
| ***C06C 15/00*** | (2006.01) |
| ***C06B 33/14*** | (2006.01) |

(52) U.S. Cl.

CPC ..... *C06B 33/14* (2013.01); *C06C 15/00* (2013.01)

USPC ..... 149/61; 149/22; 149/109.2; 149/109.4

(58) Field of Classification Search

USPC ..... 149/22, 61, 109.2, 109.4

See application file for complete search history.

(56) References Cited

U.S. PATENT DOCUMENTS

| | | | |
|---|---|---|---|
| 1,708,151 | A | 4/1929 | Pritham |
| 3,088,857 | A | 5/1963 | Matusewicz |
| 3,498,857 | A | 3/1970 | Lehikoninen |
| 3,664,898 | A | 5/1972 | Taylor et al. |

(Continued)

FOREIGN PATENT DOCUMENTS

| | | |
|---|---|---|
| FR | 392 903 | 12/1908 |
| GB | 435 588 | 9/1935 |
| WO | 03/093402 A2 | 11/2003 |

OTHER PUBLICATIONS

Nagamachi, Marcio Y., et al., "ADN—The new oxidizer around the corner for an environmentally friendly smokeless propellant," Journal of Aerospace Technology and Management, vol. 1, No. 2, Jul.-Dec. 2009. pp. 153-160.

(Continued)

*Primary Examiner* — James McDonough

(74) *Attorney, Agent, or Firm* — Griffin & Szipl, P.C.

(57) ABSTRACT

A powdery pyrotechnic mixture is proposed that comprises a binary or ternary inorganic oxidizing agent mixture composed of one or two metal oxides, a nitrate totaling 50.0% by weight to 85.0% by weight, an elementary inorganic fuel or a mixture of elementary inorganic fuels totaling 15.0% by weight to 40.0% by weight, a stabilized nitrocellulose or a nitrocellulose-based propellant powder from 0.0% by weight to 25.0% by weight, graphite from 0.0% by weight to 5.0% by weight as well as. Optionally. a further processing aid from 0.0% by weight to 5.0% by weight. The powdery pyrotechnic mixture excels in that it contains no chlorate-containing compound and/or perchlorate-containing compound as an oxidizing agent and no sulfur or a sulfur-containing compound as fuel. The proposed pyrotechnic mixture is used in pyrotechnic objects and ammunition for the production of a bang-effect and/or flash effect.

11 Claims, 1 Drawing Sheet

(56) References Cited

U.S. PATENT DOCUMENTS

| | | | | |
|---|---|---|---|---|
| 3,702,792 | A * | 11/1972 | Walter et al. | 149/10 |
| 4,363,273 | A | 12/1982 | Luebben et al. | |
| 7,578,895 | B1 * | 8/2009 | Chen et al. | 149/37 |
| 8,161,883 | B1 | 4/2012 | Harasts et al. | |
| 2002/0023699 | A1 * | 2/2002 | Matsuoka et al. | 149/36 |
| 2002/0124716 | A1 | 9/2002 | Grimm et al. | |
| 2003/0056865 | A1 | 3/2003 | Wanninger et al. | |
| 2003/0145924 | A1 | 8/2003 | Carter, Jr. | |
| 2011/0284140 | A1 | 11/2011 | Muller et al. | |

OTHER PUBLICATIONS p. 788 of Hawley's Condensed Chemical Dictionary (1987).

Drucksensor (Pressure Sensor) downloaded from http:www.directindustry.de/prod/pcb-piezotronics/drucksensoren-74 . . . on Nov. 25, 2011.

May, Joseph E., et al., "Comparison of Output and Sensitivity of Various Flash Compositions Commonly Used in Pyrotechnics," International Pyrotechnic Symposium, 2006, Fort Collins, CO, USA, pp. 439-458.

Random House Webster's College Dictionary 501 and 1099 (1991).

IPI Product Specification Akardite II, at http://www.islandgroup.com/specs/akardite__ii__n-methyl-n__n-diphenylurea.php (2011).

A. Gonzalez et al., Spheroidal Propellant Stabilizer Studies, 19th International Symposium of Ballistics 147-153.

International Search Report issued in co-pending related application PCT/EP2011/005755, completed Jun. 22, 2012 and mailed Mar. 7, 2012.

Zitierung in Betracht gezogener Druckschriften in co-pending related German application 10 2010 052 628.5, dated Jul. 6, 2011, with English machine translation.

* cited by examiner

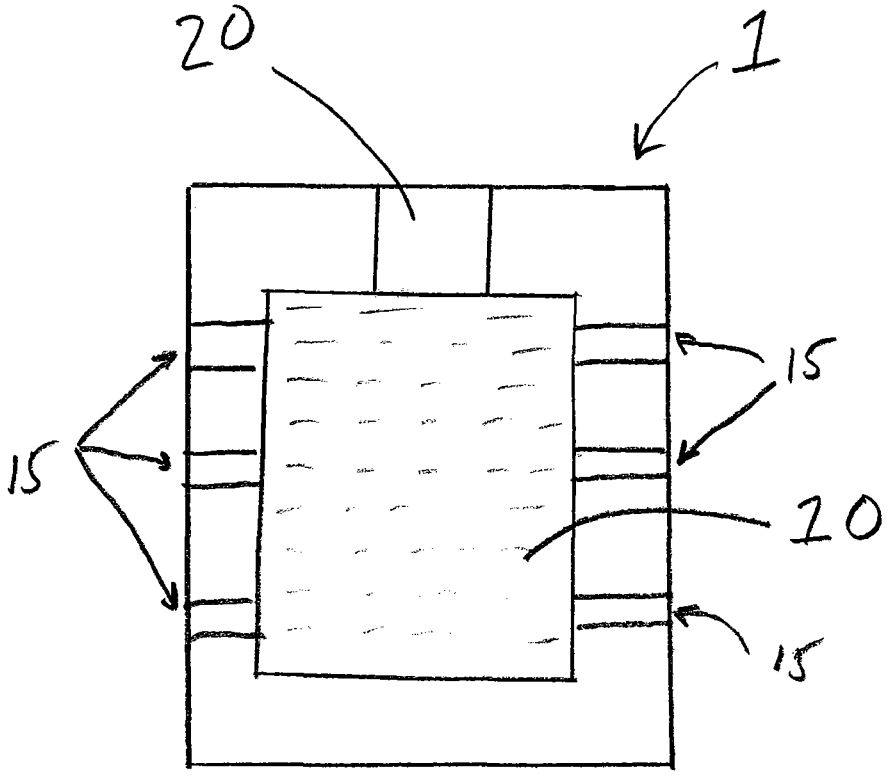
20
1
15
15
20
15

PERCHLORATE-FREE PYROTECHNIC MIXTURE

This application claims priority from U.S. Provisional Patent Application No. 61/470,065, filed Mar. 31, 2011, and on German Patent Application No. DE 10 2010 052 628.2, filed Nov. 29, 2010, the entire disclosures of which are incorporated herein by reference.

FIELD OF THE INVENTION

The invention deals with the preparation of perchlorate-free, binary and ternary inorganic oxidizing agent mixtures and powdery pyrotechnic mixtures to be produced therewith, which mixtures, incorporated in pyrotechnic objects and/or ammunition, are used preferably for the production of bang-effects and/or flash effects.

BACKGROUND OF THE INVENTION

Established pyrotechnic mixtures for the production of bang-effects and/or flash effects are, e.g., black powder, mixtures of potassium perchlorate with metal powders, or mixtures of barium nitrate with metal powders optionally with the addition of sulfur. The use of barium peroxide-based pyrotechnic mixtures for the production of bang-effects and/or flash effects in military applications no longer meets the requirements due to the lack of handling safety in the extended temperature range. The same also applies to mixtures based on potassium chlorate.

To produce high sound pressure performances in so-called "flash-bang" grenades, particularly effective mixtures of potassium perchlorate with metal powders such as aluminum, magnesium or alloys thereof, are suitable. In addition to a high performance level, these mixtures excel in their handling safety and storage stability. The temperature stability and low water solubility of the potassium perchlorate used as oxidizing agent is, i.a., responsible for this.

Due to ecotoxicological and human toxicological concerns against the use of perchlorate-containing compounds, in the meantime, on the part of the personnel, there are requirements for appropriately perchlorate-free applications with performance characteristics that remain the same as perchlorate-containing applications as far as possible. As a rule, the simple substitution of perchlorate-containing pyrotechnic mixtures by those based on a nitrate of alkali metals, or alkaline-earth metals, leads with the given design to distinct performance losses, at least unless another performance-raising additive is used. Against the background of limiting guidelines with respect to weight, geometry and freedom from fragments of the respective applications, a fulfillment of the more recent requirements can only be expected via a combined solution comprising new pyrotechnic mixtures combined with designs specific thereto.

With U.S. Pat. No. 7,578,895 A, perchlorate-free flash-bang mixtures were suggested for use in pyrotechnic practice ammunition, including their production-methods and mixing methods. These flash-bang mixtures are composed of 45.0%, by weight, to 60.0%, by weight, potassium nitrate as oxidizing agent, 0.5% by weight to 1.5% by weight boric acid as pH stabilizer, 0.2% by weight to 0.8% by weight of an anti-baking agent, preferably silicon dioxide, 35.0% by weight to 45.0% by weight aluminum powder as metallic combustible material, 5.0% by weight to 10.0% by weight of a nonmetallic combustible material, preferably sulfur, approx. 0.5% by weight carbon or graphite and 0% by weight to 10.0% by weight of a "ballistic accelerator" such as black powder, cellulose nitrate, or a commercially available single-base or double-base propellant powder. Some of the test results relating to U.S. Pat. No. 7,578,895 A were presented by the inventors at the International Pyrotechnic Symposium 2006 for mixtures with potassium nitrate as well as with strontium nitrate.

During this same event, another group of United States scientists published research on performance-raising additives that have been known for a long time, or on known perchlorate-based mixture systems that are postulated to be components of this type (c.f., Comparison of Output and Sensitivity of Various Flash Compositions Commonly Used in Pyrotechnics; Joseph E. May, Jr.; Joseph A. Domanico; International Pyrotechnic Symposium, 2006, Fort Collins, CO, USA). In addition to the peak pressure performance and sound performance, the shock sensitivity of various powder mixtures was ascertained quantitatively in comparison with a standard mixture of 70%, by weight, potassium perchlorate and 30%, by weight, aluminum powder.

The partial substitution of the metallic fuel, in this case aluminum, by up to approx. 10% by weight sulfur or a sulfur-containing, sulfidic inorganic compound, as far as the peak pressure performance is concerned, leads to a rise in performance with simultaneous increase of the shock sensitivity. Since for some armed forces the use of sulfur or sulfidic inorganic compounds is forbidden in flash-bang applications, in the scope of the present invention, the use of sulfur or corresponding sulfur-containing compounds was deliberately omitted.

The partial replacement of a classic flash-bang mixture by a gas-forming, pyrotechnic component/a "ballistic accelerator" (black powder, nitrocellulose or propellant powder) can lead to a rise in performance as far as the peak pressures to be attained are concerned. As a rule, a simultaneous increase in the shock sensitivity is again observed thereby. With a replacement of approx. more than one third of the original classical flash-bang mixture observed here, a drop in performance is observed with respect to the peak pressure.

The variation of the quality of the aluminum used, as well as its replacement by another metallic fuel of different qualities, can lead to increases in performance in some cases even without a rise in the shock sensitivity, but here, in the case of magnesium, for example, it must be taken into consideration that this cannot be used automatically in military applications without a corresponding surface treatment or a coating to increase the stability of the mixture. An appropriate surface treatment, or a coating, leads, as a rule, to mixtures whose performance is poorer, possibly even with an increase in the shock sensitivity (chromatized magnesium).

The object, and thus the aim, of the present invention is the preparation of novel perchlorate-free, powdery pyrotechnic mixture systems that, used in pyrotechnic objects and/or ammunition, serve to produce bang effects and/or flash effects.

SUMMARY OF THE INVENTION

The above object(s) of the invention are achieved in accordance with a first embodiment of the present invention, which pertains to a powdery pyrotechnic mixture for the production of bang-effects and/or flash effects, characterized in that this mixture is a binary or ternary inorganic oxidizing agent mixture. In accordance with a second embodiment of the present invention, the first embodiment is modified so that the binary or ternary inorganic oxidizing agent mixture is composed of a nitrate, and one or two metal oxides, so that the oxidizing agent mixture provides a total of 50.0% by weight to 85.0% by weight of the pyrotechnic mixture. In accordance with a third embodiment of the present invention, the first embodiment or the second embodiment is further modified so that the mixture is a binary or ternary inorganic oxidizing agent mixture composed of a nitrate from the group of the alkali metals or alkaline-earth metals, and one or two metal oxides, which total 50.0% by weight to 85.0% by weight of the pyrotechnic mixture, wherein the metal oxide is an oxide of manganese.

In accordance with a fourth embodiment of the present invention, the first embodiment, the second embodiment, and the third embodiment are further modified so that the binary or ternary inorganic oxidizing agent mixture, relative to the total composition of the pyrotechnic mixture, is composed of 35.0% by weight to 80.0% by weight of a nitrate from the group of the alkali metals or alkaline-earth metals, and 4.0% by weight to 50% by weight of a manganese oxide, or 4.0% by weight to 50% by weight of a metal oxide of the groups I B, II B, V B, VI B, VII B, VIII B, of tin or lead (group IV A) or bismuth (group V A) and a manganese oxide. In accordance with a fifth embodiment of the present invention, the first embodiment, the second embodiment, the third embodiment, and the fourth embodiment, are further modified so that this mixture contains a binary or ternary inorganic oxidizing agent mixture totaling 50.0% by weight to 85% by weight, and an elementary inorganic fuel or a mixture or an alloy of elementary inorganic fuels, preferably aluminum, boron, magnesium or titanium or mixtures or alloys of the same totaling 15.0% by weight to 40.0% by weight, and graphite from 0.0% by weight to 5.0% by weight.

In accordance with a sixth embodiment of the present invention, the first embodiment, the second embodiment, the third embodiment, the fourth embodiment, and the fifth embodiment, are further modified so that the powdery pyrotechnic mixture additionally contains a stabilized nitrocellulose or a nitrocellulose-based propellant powder in amounts of 0.0% by weight to 25% by weight. In accordance with a seventh embodiment of the present invention, the first embodiment, the second embodiment, the third embodiment, the fourth embodiment, the fifth embodiment, and the sixth embodiment, are further modified so that the powdery pyrotechnic mixture additionally contains aluminum oxide or boron nitride or silicon dioxide or titanium dioxide or magnesium stearate or zinc stearate or a substituted urea derivative, preferably Arkadit II, (also known as Akardite II, which both pertain to N-methyl-N',N'-dipheylurea),in amounts up to 5.0% by weight. In accordance with an eighth embodiment of the present invention, pyrotechnic objects and/or ammunition—including hand-thrown bodies and stationary applications—for the production of bang effects and/or flash effects, and pyrotechnic objects and/or ammunition—including hand-thrown bodies and stationary applications—with partial loads or submunitions for the production of bang- and/or flash effects are provided, wherein these various devices contain a pyrotechnic mixture according to the first embodiment, the second embodiment, the third embodiment, the fourth embodiment, the fifth embodiment, the sixth embodiment, and the seventh embodiment of the present invention.

US 2002/0023699 A1, which is incorporated herein by reference for all that it discloses, presents pyrotechnic mixtures that, as an oxidizing agent, can contain a mixture of potassium nitrate, manganese dioxide, and a further metal oxide. As fuel, an organic nitrogen-containing compound is used. To reduce the noxious gases, carbon monoxide and nitrogen, arising during the reaction, the addition of a metal oxide is suggested. The catalytic properties for converting the noxious gases into carbon dioxide and nitrogen are taken into consideration hereby. Any oxidizing agent properties of the metal oxides employed by the present invention are not discussed further.

As oxidizing agent, the present invention employs a series of metal oxides that are used in pyrotechnic thermite, delay-, and/or ignition mixtures. As a rule, binary mixtures of many metal oxides with elementary fuels, such as base metal powders or boron, tend to exhibit a rather moderate combustion behavior with the liberation of large amounts of heat, as is also frequently used in thermite mixtures. Some oxides, such as, for example, manganese dioxide or minium, when mixed with other pyrotechnic components react in a comparatively more violent manner, and are preferred for use in delay mixtures or ignition mixtures. With the exception of copper(II) oxide, in the field of pyrotechnics (in a binary mixture with titanium or zirconium), metal oxides have not previously been used in pyrotechnic mixtures for the production of bang-effects and/or flash effects.

The mixtures of alkali metal or alkaline-earth metal nitrates with the corresponding metal powder, whose performance is poorer than the potassium perchlorate/metal powder system, are used, in accordance with the present invention, to raise the reaction rate of the total mixture by incorporating an energy-rich "thermite-type" reaction. The utilization of this effect in pyrotechnic mixtures for the production of bang-effects and/or flash effects contains a secure pointer to the solution.

Moreover, in mixtures of the alkali metal, or alkaline-earth metal nitrates, with metal powders, some other metal oxides are also capable of increasing the reduced ignition sensitivity, compared with a system provided with potassium perchlorate/metal powder. For this purpose, metal oxides are optionally suitable in that when energy is supplied, they partially cleave oxygen and/or thereby reduce the ignition temperature of the pyrotechnic total mixture (oxidizing agent mixture plus fuel) compared with the corresponding binary mixtures (nitrate component plus fuel or metal oxide plus fuel). Manganese dioxide is known as an additive that raises the ignition sensitivity of pyrotechnic mixtures, but has likewise not been used hitherto in mixtures for the production of bang-effects and/or flash effects.

In addition to the known requirements for metal oxides used in thermites, such as 1. minimal heat production,
2. high oxygen content,
3. high specific weight,
4. reducible to a metal that has a low melting temperature and a high boiling temperature, the metal oxides used in the flash-bang mixtures of the present invention can be reduced to metals with low boiling temperatures. According to the invention, this takes place differently from the requirements in thermite mixtures.

With the use of manganese dioxide as a performance-raising additive, balanced two-component systems composed of an alkali metal or alkaline-earth metal nitrate and a metallic fuel can be replaced partially by manganese dioxide. Depending on the manganese dioxide percentage, various strongly oxygen-overbalanced mixtures result herefrom.

BRIEF DESCRIPTION OF THE DRAWING(S)

FIG. 1 schematically illustrates a pyrotechnic device 1, such as a pyrotechnic object and/or ammunition—including hand-thrown bodies and stationary applications—for the production of bang effects and/or flash effects, or a pyrotechnic object and/or ammunition—including hand-thrown bodies and stationary applications—with partial loads or submunitions for the production of bang- and/or flash effects, wherein the device contains a pyrotechnic mixture 20 in accordance with the present invention.

DETAILED DESCRIPTION OF THE INVENTION

The present invention pertains generally to a perchlorate-free, powdery pyrotechnic mixture, wherein the powdery pyrotechnic mixture comprises (a) a binary or ternary inorganic oxidizing agent mixture composed of one or two metal oxides, and a nitrate, wherein the binary or ternary inorganic oxidizing agent totals 50.0% by weight to 85.0% by weight, of the pyrotechnic mixture, (b) an elementary inorganic fuel or a mixture of elementary inorganic fuels totaling 15.0% by weight to 40.0% by weight, of the pyrotechnic mixture, and (c) a stabilized nitrocellulose or a nitrocellulose-based propellant powder from 0.0% by weight to 25.0% by weight, of the pyrotechnic mixture, and (d) graphite from 0.0% by weight to 5.0% by weight as well as optionally (e) a further processing aid from 0.0% by weight to 5.0% by weight, of the pyrotechnic mixture. The powdery pyrotechnic mixture excels in that it contains no chlorate-containing compound and/or perchlorate-containing compound as an oxidizing agent and no sulfur or a sulfur-containing compound as fuel. The proposed pyrotechnic mixture is used in pyrotechnic objects and ammunition for the production of a bang-effect and/or flash effect.

Description of Various Components of the Pyrotechnic Mixture of the Invention

In Table 1, Examples 2 through 4 are listed for the performance-raising additive to the strontium nitrate/aluminum system. When used as a performance-raising oxidizing agent component, the alkali metal or alkaline-earth metal nitrates are replaced partially by manganese oxides, while the metallic fuel percentage was held in the range of 23% by weight to 30% by weight (Table 1 or 2, Example 5 and Table 2, Example 7). Moreover, it has proved that a multiplicity of metal oxides are basically suitable to raise performance by integration into binary pyrotechnic mixtures of an alkali metal or alkaline-earth metal nitrate and an elementary inorganic fuel. Corresponding mixtures with iron(II, III) oxide (Table 2, Example 8), molybdenum trioxide (Table 2, Example 9) and copper(II) oxide (Table 2, Example 10) in the base system strontium nitrate/aluminum were tested (by way of example). When metal oxides were used as a performance-raising oxidizing agent component (assuming that these react to the respective elementary metal), the resulting pyrotechnic mixtures were balanced with respect to the oxygen balance.

Compared with the binary strontium nitrate/aluminum powder mixture, moreover, a distinct rise in the burning rate (up to approx. 14.6 times at an $MnO_2$ percentage of approx. 14.6% by weight) is possible by adding manganese dioxide. Moreover, this most reactive mixture is also simultaneously the most ignition-sensitive, since, in contrast to Example mixtures 1, 2 and 4, it can be triggered by a lower thermal ignition impulse.

TABLE 1

Use of $MnO_2$ as performance-raising additive or performance-raising oxidizing agent component

| | Composition/% by weight | | | | Burn channel (cross-sectional area) | |
|---|---|---|---|---|---|---|
| Example | $MnO_2$ | $Sr(NO_3)_2$ | Al | Graphite | cm/s (17.0 $mm^2$) | cm/s (5.8 $mm^2$) |
| 1 | — | 88.16 | 28.93 | 2.91 | 7.4 ± 0.9 | No ignition |
| 2 | 4.85 | 64.75 | 27.49 | 2.91 | 19.1 ± 1.2 | No ignition |
| 3 | 14.56 | 57.93 | 24.59 | 2.91 | 108.5 ± 17.1 | Incomplete burning |
| 4 | 33.98 | 44.30 | 18.81 | 2.91 | 21.3 ± 2.2 | No ignition |
| 5 | 34.17 | 34.17 | 28.74 | 2.91 | Not measurable manually! | 170.5 ± 57.5 |
| Ref.: $KClO_4$ (64.08)/Al (33.01)/ graphite (2.91) | | | | | — | 62.1 ± 15.4 |

Compared with the binary strontium nitrate/aluminum powder mixture, a clear increase in the burn rate was evident with the use of binary oxidizing agent mixtures based on strontium nitrate and the metal oxides given here, such as oxygen-balanced mixtures with aluminum powder. In particular, manganese dioxide exhibits great potential both as a performance-raising additive and also as a performance-raising oxidizing agent component. The comparison of the linear burn rates of Example mixtures 3 through 5 shows that the use of manganese dioxide as an oxidizing agent component in balanced total mixtures (Example 5) leads to clearly higher performances than the mere additive, the latter leading to balanced binary mixtures of a nitrate and an inorganic fuel.

TABLE 2

Use of various metal oxides as performance-raising oxidizing agent component

| | Composition/% by weight | | | | Burn channel (cross-sectional area) | |
|---|---|---|---|---|---|---|
| Example | $Me_xO_y$ | $Sr(NO_3)_2$ | Al | Graphite | cm/s (17.0 $mm^2$) | cm/s (5.8 $mm^2$) |
| 1 | — | 68.16 | 28.93 | 2.91 | 7.4 ± 0.9 | No ignition |
| 5 | 34.17 ($MnO_2$) | 34.17 | 28.74 | 2.91 | Not measurable manually! | 170.5 ± 57.5 |
| 7 | 35.44 ($Mn_3O_4$) | 35.44 | 26.21 | 2.91 | 95.1 ± 12.6 | 41.8 ± 2.0 |

TABLE 2-continued

| Use of various metal oxides as performance-raising oxidizing agent component | | | | | | |
|---|---|---|---|---|---|---|
| | Composition/% by weight | | | | Burn channel (cross-sectional area) | |
| Example | $Me_xO_y$ | $Sr(NO_3)_2$ | Al | Graphite | cm/s (17.0 $mm^2$) | cm/s (5.8 $mm^2$) |
| 8 | 22.33 ($Fe_3O_4$) | 47.57 | 27.18 | 2.91 | 35.3 ± 3.1 | — |
| 9 | 34.66 ($MoO_3$) | 34.86 | 27.77 | 2.91 | 53.9 ± 5.1 | 35.3 ± 3.1 |
| 10 | 36.60 (CuO) | 38.80 | 23.88 | 2.91 | 104.7 ± 28.4 | No ignition |
| Ref.: $KClO_4$ (64.08)/Al (33.01)/ graphite (2.91) | | | | | — | 62.1 ± 15.4 |

The suitability of metal oxides for raising the performance of mixtures of nitrates of an alkali metal or alkaline-earth metal with an elementary inorganic fuel is demonstrated. The use of binary inorganic oxidizing agent mixtures based on a nitrate, preferably an alkali metal or alkaline-earth metal nitrate and a metal oxide, preferably manganese dioxide, in appropriately balanced pyrotechnic mixtures (under the assumption of the reduction of the metal oxide to produce the elementary metal) for the production of bang-effects and/or flash effects is forward-looking. Based on the observed potential of manganese dioxide, the suitability of ternary inorganic oxidizing agent mixtures based on a nitrate, manganese dioxide, as well as a further metal oxide in pyrotechnic mixtures for the production of bang-effects and/or flash effects is demonstrated.

The balancing of these now perchlorate-free pyrotechnic mixtures under the assumption of the reduction of the metal oxide to produce the elementary metal, however, does not necessarily mean that these also arise in the reaction. Thus, under the reaction conditions, depending on the nature of the respective metal, as a rule with the formation of the corresponding oxides from the finely divided hot metal particles occur in combination with the atmospheric oxygen. Moreover, the formation of mixed oxides is likewise not to be excluded. Therefore, depending on the mixture ratio of the metal oxide or the metal oxides and nitrate component, and/or depending on the properties of the oxidizing agent components and/or the metal liberated from the metal oxide or the metal oxides or the liberated metals, the balancing of the pyrotechnic mixture is to be adjusted.

From the large number of existing metal oxides, those suited for an, in principle, performance-raising effect are preferably those that can be reduced with aluminum, boron, magnesium, silicon or titanium, as the current fuels in thermite mixtures with the release of large amounts of heat to produce the element. These include the metal oxides of the sub groups I B, II B, V B, VI B, VII B, VIII B, as well as the metal oxides of tin and lead (group IV A) and bismuth (group V A). In addition, some non-metal oxides such as boron oxide, silicon dioxide or iodine (V) oxide can be used as potentially performance-raising additives or oxidizing agent component, but with the exception of iodine(V) oxide, the performance-raising effect may be disregarded due to the low reaction heat of these thermite reactions. The same holds true for the metal oxides of group IVB. The metal oxides of the group IIIB are not suitable for this use anyway, since they cannot be prepared metallothermally.

In addition to the metal oxides and nonmetal oxides that are suitable, in principle, it is also possible to use "masked" metal oxides in the form of carbonyl compounds, carbonates or oxalates that readily break down into the corresponding oxides under the addition of heat. Examples that should be named here are the carbonyl compounds of metals of group VIB, manganese(II) carbonate, manganese(II) oxalate, iron (II) carbonate, iron(II) oxalate, or copper(II) carbonate.

With respect to the increase in the reaction rate of pyrotechnic mixtures based on an oxidizing agent mixture of a nitrate-oxide and a metal oxide component, as well as an inorganic fuel, metal oxides are suitable in particular that:

(a) metal oxides release large amounts of heat in thermite reactions, (b) metal oxides have a high linear burn rate as a powder thermite mixture, and (c) metal oxides are reduced to metals with low boiling temperatures.

For an increase in ignition sensitivity that is to be a further target, reactive metal oxides, whose thermite mixtures have a comparatively low ignition temperature and/or when heat is supplied react readily with oxygen cleavage (usually connected with disproportionation), are particularly suitable. Examples to be named here would be the dioxides of lead and manganese, as well as optionally those of molybdenum and tungsten. In view of the performance, production safety and handling safety, tolerance and stability and human toxicology and ecotoxicology, the oxides of manganese are primarily suitable for practical applications in accordance with the present invention.

The performance of this new group of flash-bang mixtures can be controlled by varying the nitrate component used, the metal oxide or oxides used, as well as by varying the fuel used. A preferable composition of this new group of flash-bang mixtures, in accordance with the present invention, comprises (a) a binary oxidizing agent mixture of an alkali metal or alkaline-earth metal nitrate and a metal oxide totaling 50.0% by weight to 85.0% by weight of the flash-bang mixture, (b) an elementary inorganic fuel or a mixture or an alloy of elementary inorganic fuels totaling 15.0% by weight to 40.0% by weight of the flash-bang mixture, as well as (c) graphite in amounts of 3% by weight to 5% by weight of the flash-bang mixture. The preferred metal oxide is manganese dioxide, and the preferred inorganic fuels are aluminum, boron, magnesium and titanium or mixtures or alloys thereof. For reasons of handling safety, the use of zirconium as a fuel is deliberately disregarded here. In other words, the use of zirconium as a fuel is avoided because it is not as safe to handle as the other inorganic fuels listed above.

Testing of the Pyrotechnic Mixtures of the Invention

While varying the fuels in combination with 1:1 mixtures of strontium nitrate and manganese dioxide, the performance of the new group of flash-bang mixtures 10 was tested in test blocks 1 with radially arranged blow-off openings 15 with initial weights of approx. 9.0 g. For this purpose, test blocks were fixed in 1.22 m, and the sound pressure was measured by means of four PCB pressure sensors (such as pressure sensor Model 101A, 100 psi, 50 mV, PCB Piezoelectronics, Inc.) at a distance of 1.22 m. Ignition took place via a pyrotechnic delay element 20 (See FIG. 1).

Table 3 summarizes the results of the above pyrotechnic testing with respect to measured sound pressure. The suggested powder pyrotechnic mixture, in accordance with the present invention, thus excels in that it contains no chlorate- and/or perchlorate-containing compound as oxidizing agent and no sulfur or sulfur-containing compound as fuel. However, the sound pressure attained by the pyrotechnic mixtures, in accordance with the present invention, are suitable for use as flash-bang pyrotechnic mixtures.

TABLE 3

Variation of the fuel component with an identical oxidizing agent mixture

| Composition | Fuel | Sound pressure |
|---|---|---|
| 1:1 $Sr(NO_3)_2/MnO_2$ + | Aluminum | 160 dB-185 dB |
| 1:1 $Sr(NO_3)_2/MnO_2$ + | Magnesium | Approx. 185 dB |
| 1:1 $Sr(NO_3)_2/MnO_2$ + | Titanium | 165 dB-1170 dB |
| Reference: | $KClO_4$/Al/graphite | 180 dB |

In addition, a further performance rise of these new flash-bang mixtures can be increased by the addition of up to 25%, by weight, of a "ballistic accelerator" in the form of a stabilized nitrocellulose or a nitrocellulose-based propellant powder. With an identical measuring set-up as described above, performance rises of approx. 5 dB were obtained from pyrotechnic mixtures in which a ballistic accelerator was added.

In addition, these new flash-bang mixtures of the present invention can also have a further component, up to 5% by weight, in the form of a processing aid or stabilizer. These further components can be oxides of aluminum, silicon or titanium, or boron nitride or magnesium stearate or zinc stearate, or a substituted urea derivative, preferably Arkadit II.

The present invention realizes the preparation of a perchlorate-free pyrotechnic mixture system that, when incorporated in flash-bang grenades, preferably with head- and foot relief holes, is capable of producing sound pressure performances of 170 dB to 185 dB at distances of 1.2 m to approx. 2.0 m.

In accordance with a preferred embodiment of the present invention, a perchlorate-free, powdery pyrotechnic mixture (100 wt. %) comprises (a) a binary inorganic oxidizing agent mixture composed of one or two metal oxides, and a nitrate, wherein the binary inorganic oxidizing agent totals 50.0% by weight to 85.0% by weight, of the pyrotechnic mixture, (b) an elementary inorganic fuel or a mixture of elementary inorganic fuels totaling 15.0% by weight to 40.0% by weight, of the pyrotechnic mixture, and (c) graphite from 3.0% by weight to 5.0% by weight of the pyrotechnic mixture as well as (d) a processing aid in an amount up to 5.0% by weight, of the pyrotechnic mixture. In accordance with this preferred embodiment of the present invention, the one or two metal oxides preferably consists of one metal oxide and the binary inorganic oxidizing agent includes the one metal oxide and an alkali or alkaline earth metal nitrate. The processing aid is a performance-raising additive selected from among those described above.

The invention claimed is:

1. A powdery pyrotechnic mixture for the production of bang effects, or flash effects, or bang effects and flash effects, wherein the pyrotechnic mixture comprises:

(a) a binary or ternary inorganic oxidizing agent mixture, wherein the binary or ternary inorganic oxidizing agent mixture comprises
  (i) strontum nitrate; and
  (ii) a first metal oxide or a first and a second metal oxide, wherein the first metal oxide is manganese dioxide, wherein the inorganic oxidizing agent mixture totals 50.0%, by weight, to 85.0%, by weight, of the pyrotechnic mixture;

(b) an elementary inorganic fuel, or a mixture or an alloy of elementary inorganic fuels, wherein the elementary inorganic fuel, or mixture or alloy of elementary inorganic fuels, totals 15.0%, by weight to 40.0%, by weight, of the pyrotechnic mixture, that are in combination with a 1:1 mixture of strontium nitrate and manganese dioxide; and (c) graphite, wherein the graphite totals 0.0%, by weight, to 5.0%, by weight, of the pyrotechnic mixture.

2. A powdery pyrotechnic mixture for the production of bang effects, or flash effects, or bang effects and flash effects, wherein the pyrotechnic mixture comprises:

(a) a binary or ternary inorganic oxidizing agent mixture, wherein the binary or ternary inorganic oxidizing agent mixture comprises
  (i) strontium nitrate; and
  (ii) a first metal oxide or a first and a second metal oxide, wherein the first metal oxide is manganese dioxide, wherein the inorganic oxidizing agent mixture totals 50.0%, by weight, to 85.0%, by weight, of the pyrotechnic mixture;

(b) a stabilized nitrocellulose or a nitrocellulose-based propellant powder in amounts of 0.0% by weight to 25% by weight of the pyrotechnic mixture;

(c) an elementary inorganic fuel, or a mixture or an alloy of elementary inorganic fuels, totaling 15.0% by weight to 40.0% by weight of the pyrotechnic mixture, that are in combination with a 1:1 mixture of strontium nitrate and manganese dioxide, and graphite from 3% by weight to 5% by weight of the pyrotechnic mixture; and (d) a substituted urea derivative, in amounts up to 5.0% by weight of the pyrotechnic mixture, wherein the substituted urea derivative is Akardite II.

3. A powdery pyrotechnic mixture according to claim 2, wherein the second metal oxides is an oxide of manganese other than manganese dioxide.

4. A powdery pyrotechnic mixture according to claim 2, wherein the binary or ternary inorganic oxidizing agent mixture, relative to the total composition of the pyrotechnic mixture, comprises (1) 35.0% by weight to 80.0% by weight of the strontium nitrate, and (2) 4.0% by weight to 50% by weight of manganese dioxide, or 4.0% by weight to 50% by weight of manganese dioxide, and a metal oxide selected from the group consisting of the metal oxide groups I B, II B, V B, VI B, VII B, and VIII B, tin or lead of group IV A, bismuth of group V A, and a manganese oxide other than manganese dioxide.

5. A powdery pyrotechnic mixture according to claim 2, wherein the pyrotechnic mixture additionally comprises:

(e) aluminum oxide or boron nitride or silicon dioxide or titanium dioxide or magnesium stearate or zinc stearate or a substituted urea derivative, in amounts up to 5.0% by weight of the pyrotechnic mixture.

6. A pyrotechnic device for the production of bang effects, or flash effects, or bang effects and flash effects, wherein the pyrotechnic device is selected from the group consisting of pyrotechnic objects, ammunition, and pyrotechnic objects and ammunition that include hand-thrown bodies and stationary applications, wherein the pyrotechnic device contains the pyrotechnic mixture according to claim 2.

7. A powdery pyrotechnic mixture according to claim 5, wherein the pyrotechnic mixture additionally comprises the substituted urea derivative, in amounts up to 5.0% by weight of the pyrotechnic mixture, wherein the substituted urea derivative is Akardite II.

8. A pyrotechnic device, wherein the pyrotechnic device is selected from the group consisting of pyrotechnic objects, ammunition, and pyrotechnic objects and ammunition that include hand-thrown bodies and stationary applications provided with partial loads or submunitions for the production of bang effects, or flash effects, or bang effects and flash effects, wherein the pyrotechnic device contains the pyrotechnic mixture according to claim 2.

9. A powdery pyrotechnic mixture according to claim 2, wherein the elementary inorganic fuel, or the mixture or alloy of elementary inorganic fuels, comprises aluminum, boron, magnesium, titanium, or mixtures or alloys of aluminum boron, magnesium or titanium.

10. A powdery pyrotechnic mixture according to claim 4, wherein the elementary inorganic fuel, or the mixture or alloy of elementary inorganic fuels, comprises aluminum, boron, magnesium, titanium, or mixtures or alloys of aluminum boron, magnesium or titanium.

11. A powdery pyrotechnic mixture according to claim 5, wherein the elementary inorganic fuel, or the mixture or alloy of elementary inorganic fuels, comprises aluminum, boron, magnesium, titanium, or mixtures or alloys of aluminum boron, magnesium or titanium.

* * * * *